US011014254B2

(12) United States Patent
Nijdam

(10) Patent No.: US 11,014,254 B2
(45) Date of Patent: May 25, 2021

(54) HAIR CUTTING APPARATUS COMPRISING A CURRENT DETECTOR

(71) Applicant: KONINKLIJKE PHILIPS N.V., Eindhoven (NL)

(72) Inventor: Jeroen Christian Nijdam, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 142 days.

(21) Appl. No.: 16/349,666

(22) PCT Filed: Nov. 29, 2017

(86) PCT No.: PCT/EP2017/080736
§ 371 (c)(1),
(2) Date: May 14, 2019

(87) PCT Pub. No.: WO2018/099932
PCT Pub. Date: Jun. 7, 2018

(65) Prior Publication Data

US 2019/0275687 A1 Sep. 12, 2019

(30) Foreign Application Priority Data

Dec. 1, 2016 (EP) ..... 16201827

(51) Int. Cl.
*B26B 19/38* (2006.01)
*B26B 19/04* (2006.01)
*B26B 19/14* (2006.01)

(52) U.S. Cl.
CPC ..... *B26B 19/388* (2013.01); *B26B 19/3853* (2013.01); *B26B 19/04* (2013.01); *B26B 19/14* (2013.01)

(58) Field of Classification Search
CPC ... B26B 19/38; B26B 19/3873; B26B 19/388; B26B 19/3853; B26B 19/386
USPC ..... 30/43–46
See application file for complete search history.

(56) References Cited

U.S. PATENT DOCUMENTS 4,514,667 A * 4/1985 Sakmann ..... H02P 6/14 318/400.01
5,367,599 A * 11/1994 Okada ..... B26B 19/28 388/809
5,671,535 A * 9/1997 Van Der Borst ..... B26B 19/28 30/43.6
5,694,020 A * 12/1997 Lang ..... G01R 31/3648 30/45

(Continued)

FOREIGN PATENT DOCUMENTS

DE 19743853 C1 11/1998
JP 0833778 A 2/1996

*Primary Examiner* — Stephen Choi
*Assistant Examiner* — Richard D Crosby, Jr.

(57) ABSTRACT

The present invention is directed to a hair cutting apparatus (600), such as a shaver, which is enabled to detect whether hair is currently being cut in a robust way. Such apparatus has a motor (102) for driving a cutting element. The motor current (106) is evaluated by filtering and amplifying it in such a way that a time derivative of the motor current (106) is processed and other parts of the motor current (106), such as noise and DC-5 parts, are eliminated. An evaluator determines whether the time derivative of the motor current is above a predefined threshold value.

14 Claims, 5 Drawing Sheets

(56) References Cited

U.S. PATENT DOCUMENTS 5,894,670 A * 4/1999 Iso ..... B26B 19/3833 30/541
5,920,988 A * 7/1999 Momose ..... B26B 19/382 30/41
6,072,399 A * 6/2000 Cimbal ..... B26B 19/38 340/635
6,158,126 A * 12/2000 Rose, Jr. ..... B26B 19/282 30/43.92
6,189,215 B1 * 2/2001 Beerwerth ..... A45D 27/46 30/32
7,193,377 B2 * 3/2007 Fung ..... H02P 7/29 318/400.01
7,403,131 B2 * 7/2008 Gossett ..... B25C 7/00 30/382
7,683,720 B1 * 3/2010 Yehui ..... H03F 3/45192 330/311
8,943,635 B2 2/2015 Heil
8,988,018 B2 3/2015 Luckel
10,195,752 B2 * 2/2019 Perlberg ..... B26B 19/18
10,350,771 B2 * 7/2019 Perlberg ..... B26B 19/18
10,946,539 B2 * 3/2021 Nijdam ..... B26B 19/388
2002/0088121 A1 * 7/2002 Jacobsen ..... B26B 21/4056 30/34.05
2006/0207103 A1 * 9/2006 Tse ..... B26B 19/06 30/210
2007/0050995 A1 * 3/2007 Schnak ..... B26B 21/526 30/526
2007/0113409 A1 * 5/2007 Schaaf ..... H02K 33/16 30/43.92
2008/0189953 A1 * 8/2008 Jessemey ..... B26B 21/38 30/45
2009/0000126 A1 * 1/2009 Kraus ..... B26B 19/046 30/34.1
2010/0186234 A1 * 7/2010 Binder ..... H04N 5/2257 30/34.05
2011/0314677 A1 * 12/2011 Meier ..... A46B 13/02 30/41.8
2013/0227841 A1 * 9/2013 Solomon ..... A61B 18/18 30/34.05
2013/0298406 A1 * 11/2013 Chen ..... B26B 21/405 30/34.05
2013/0312579 A1 * 11/2013 Childers ..... B26B 21/4081 83/13
2015/0126981 A1 * 5/2015 Verghese ..... B26B 19/00 606/9
2015/0246454 A1 * 9/2015 Mintz ..... B26B 19/3873 30/124
2016/0167241 A1 * 6/2016 Goldfarb ..... B26B 21/28 382/108
2017/0019044 A1 * 1/2017 Godlieb ..... B26B 19/388
2017/0156796 A1 * 6/2017 Moeskops ..... A45D 7/00
2020/0033448 A1 * 1/2020 Bourquin ..... G01S 17/42
2020/0156272 A1 * 5/2020 Devries ..... B26B 19/145

* cited by examiner

HAIR CUTTING APPARATUS COMPRISING A CURRENT DETECTOR

This application is the U.S. National Phase application under 35 U.S.C. § 371 of International Application No. PCT/EP2017/080736, filed on Nov. 29, 2017 and International Application No. 16201827.9, filed Dec. 1, 2016. These applications are hereby incorporated by reference herein.

FIELD OF THE INVENTION

The invention relates to a hair cutting apparatus comprising a cutting element, a motor and a motor current detector to detect a hair-cutting action of the cutting element. The invention also relates to a method for detecting a hair-cutting action of a hair cutting apparatus.

BACKGROUND OF THE INVENTION

Such hair cutting apparatuses are known and include shaving and grooming devices. Such hair cutting apparatuses may have a sensor to sense whether the apparatus, more precisely the cutting element, is currently cutting hair. The sensing results can be used to control the hair cutting apparatus. One possibility to identify such hair-cutting actions of the cutting element is to detect and analyse the motor current. The motor current, i.e. the current powering the motor driving the cutting element, usually rises whenever a hair is being cut.

One possibility to evaluate the motor current in order to identify hair-cutting actions is to measure the voltage drop across a sense resistor. The sense resistor voltage drop is measured by a microcontroller's AD converter. The measured value of the AD converter, which is often a 10 bit value, is input to measure with Ohm's law the absolute motor current. Based on this absolute motor current value a microprocessor can identify hair-cutting actions.

However, when the motor load changes, e.g. due to wear or by using a different interchangeable shaving unit, the absolute value of the motor current will change as well. A hair-cutting action can e.g. be detected by identifying peaks in the motor current. This could be done by providing a threshold for the motor current, but setting a threshold for the motor current data to detect current peaks will not be robust enough to compensate for torque changes over time. The absolute value of the motor current may change, and using a constant threshold value may lead to different and unreliable results.

U.S. Pat. No. 5,367,599 A is directed to an electric shaver in which motor rotational speed is controlled according to beard thickness. That document suggests to process the current waveform for one shaving session and to judge the user's beard thickness.

U.S. Pat. No. 6,072,399 discloses a method to determine the quantity of hairs cut and, thereby, the degree of soiling of an electric shaver by detecting fluctuations of the motor current associated with hair-cutting actions. A control circuit of the shaver counts the number of pulses of the motor current. Alternatively, a total length of the pulses is determined, or the pulses are integrated. The counted number of pulses, the cumulative length of the pulses or the integrated area of the pulses are compared with a reference value corresponding to a predetermined quantity.

JP H08 33778 A discloses a hair cutting device having a first cutting head for cutting long hairs and having two second cutting heads for cutting short hairs, wherein the first cutting head is arranged between the two second cutting heads. The device comprises an actuator to displace the first cutting head into a retracted position relative to the two second cutting heads. The actuator is controlled by a control unit comprising a motor current sensor which is arranged to detect a current flowing through the motor which drives the first and second cutting heads. The control unit compares the average value of the detected motor current per unit time with a comparison value representing the average value per unit time of the motor current when the hair length is not more than a predetermine value. When the detected average value of the motor current per unit time satisfies the comparison value, the control unit determines that no long hairs are left on the skin and controls the actuator such that the actuator displaces the first cutting head into the retracted position relative to the two second cutting heads.

SUMMARY OF THE INVENTION

In view of the abovementioned problems, a general object of the present invention is to provide an improved hair cutting apparatus and method. In particular, an object of the invention is to provide an improved solution to detect hair-cutting actions in a more reliable manner.

According to a first aspect of the invention, a hair cutting apparatus comprises a cutting element configured to cut hair, a motor configured to drive the cutting element for cutting the hair when powered by a motor current, and a current detector configured to detect the motor current as a function of time, wherein the current detector comprises a current sensor configured to sense the motor current and to provide a current signal indicative of the sensed motor current, and wherein the current detector further comprises a current manipulator configured to determine a time derivative signal of the current signal, wherein the current manipulator comprises an evaluator configured to detect whether the time derivative signal or an amplified signal of the time derivative signal is above a predetermined threshold value to detect a hair-cutting action of the cutting element.

Such a hair cutting apparatus can be a shaving device, a grooming device or any other device for cutting hair. Any following explanations with respect to a shaver or shaving device also relate to any other cutting apparatus or any other action of cutting hair. The cutting element can be an oscillating cutting element, e.g. a linearly reciprocating cutting element, or a rotating cutting element comprising one or a plurality of hair-cutting blades or similar means for cutting hair.

The motor is mechanically connected to the cutting element, e.g. to said oscillating element or rotating element. This can be directly or by the use of a drive shaft or other mechanical connection. In order to run the motor, the motor is powered by a motor current. This motor current is detected by the current detector as a function of time. The current detector comprises at least a current sensor and a current manipulator. The current sensor senses the motor current and provides a signal indicative of the sensed motor current. One possibility to do so is to use a sense resistor through which the motor current flows, and to measure the resulting voltage across this sense resistor. This measured voltage according to this example forms the current signal, as this voltage is indicative of the sensed motor current, i.e. this voltage is basically proportional to the motor current.

The current manipulator determines a time derivative signal of the current signal. Accordingly, the current signal is differentiated with respect to time to determine said time derivative signal. In this way small but sudden changes of the current signal which are associated with hair-cutting actions by the cutting element will become dominant in the differentiated signal.

The time derivative signal or an amplified signal of the time derivative signal is compared with a predetermined threshold value to detect whether a value of the time derivative signal is above the predetermined threshold value in order to identify a hair-cutting action of the cutting element. Said comparison is done by a circuitry, or it could also be calculated by means of a microprocessor, i.e. the evaluator can be implemented as a circuitry or in a microprocessor.

Accordingly, the detection of a hair-cutting action is not based on the absolute value of the motor current but on the time derivative of the absolute motor current. The time derivative is compared with a predetermined threshold value. This makes the detection particularly robust to changes of the properties of the shaver, such as wear or soiling. Of course, the time derivative of the motor current can also be amplified before comparing it with the threshold value.

In an embodiment of the hair cutting apparatus, the current manipulator comprises a first high-pass filter adapted to determine the time derivative signal of the current signal. The first high-pass filter may comprise a series capacitor, in particular when the current signal is represented by a corresponding voltage. When the motor current is constant, i.e. if that voltage representing the motor current is constant, no current will result at this capacitor. Only changes in the motor current signal, i.e. changes in the voltage at the capacitor, result in an output at the capacitor. The capacitor differentiates the current signal, i.e. it differentiates the voltage representing the motor current as a function of time. Accordingly, the differentiation dI/dt of the current signal is performed, with "I" indicating the current signal in general and "t" indicating the time. The use of the letter "I" is only for explanation, and the current signal could also be provided as a voltage. The differentiation may alternatively be done by a circuitry, or it could also be calculated by means of a microprocessor once the current signal is digitalized.

In an embodiment of the hair cutting apparatus, the hair cutting apparatus comprises a drive system coupling the motor to the cutting element, and the current manipulator comprises a first low-pass filter configured to eliminate high frequency components of the current signal caused by torque changes of the drive system. Such torque changes of the drive system coupling the motor to the cutting element can cause frequency components in the motor current, and thus in the current signal, which are higher than the frequency components which might be caused by hair-cutting actions of the cutting element. The first low-pass filter is thus tailored to such higher frequency components. The filter cutoff frequency can be in a −3 dB range of 2 Hz to 20 Hz. The first low-pass filter is thus also designed to eliminate high frequency components in the current signal due to commutation of the motor current, and also to eliminate high frequency components due to torque changes produced by the drive train and the shaving system. Such torque changes can also be understood as noise due to their characteristic frequency range.

In an embodiment of the hair cutting apparatus, the first high-pass filter has a differentiating character for specific frequency ranges. In these specific frequency ranges the first high-pass filter differentiates the current signal and passes current changes of the current signal. The first high-pass filter is thus tailored to a frequency range configured to pass current changes of the current signal. The first high-pass filter differentiates these current changes, and in this way the evaluation of the current signal can be performed or improved. The changes of the current signal indicate changes of the motor current rising to a higher value or falling to a lower value. Effects, which are particularly related to hair-cutting actions of the cutting element, appear in a lower frequency range than the signal characteristics which were to be filtered with the first low-pass filter according to the embodiment described hereinbefore. Nevertheless, the filter cutoff frequency of the first high-pass filter can just as well be in a −3 dB range of 2 Hz to 20 Hz.

The first high-pass filter and the first low-pass filter described hereinbefore can also be combined, even with similar frequency ranges. Combining these two filters may result in a band-pass filter passing particular characteristics of the current signal or the motor current, respectively, indicative of hair-cutting actions of the cutting element.

In particular, the first high-pass filter is designed to pass only the current changes. It is designed in such a way that its output will be zero when there are no current changes. For setting the predetermined threshold value for detecting signal characteristics associated with hair-cutting actions of the cutting element, the first high-pass filter has a time-differentiating effect resulting in a time-differentiated current signal. The time-differentiated current signal, which can thus be a differentiated voltage, will be easier to observe. It is easier to compare such a time-differentiated current signal with a predefined threshold value and, thus, it is easier to set such a predetermined threshold value. The reason is that the differentiating effect of the high-pass filter results in a signal having no DC bias. In particular, there is no DC bias between multiple circuits. Accordingly, the absolute motor current or the corresponding current signal is not present anymore in this signal filtered by the first high-pass filter, i.e. differentiated by the first high-pass filter. Accordingly, the current manipulator processes basically only such changes which are associated with hair-cutting actions of the cutting element. This could be defined by a frequency range for the changes of the current signal of about 1 to 40 Hz, in particular 2 to 20 Hz.

In particular, any noise of the motor current or of the current signal indicative of the motor current is not used to detect any hair-cutting actions, but preferably such noise is reduced or eliminated. Certain characteristic changes in the motor current or changes in the current signal are taken into account when designing the current manipulator, such that only these characteristic changes are considered and used.

In an embodiment of the hair cutting apparatus, the current manipulator comprises an operational amplifier configured to amplify the time derivative signal into the amplified signal. By using this operational amplifier, any decreases of the amplitude of the current signal due to filtering can at least be compensated. In general, this operational amplifier can amplify the filtered signal and thus only the characteristics of the current signal which are of interest.

In an embodiment of the hair cutting apparatus, the first low-pass filter or the first high-pass filter according to the abovementioned embodiments or both filters are integrated into the operational amplifier. In this way the use of at least one of these filters provides a filtered signal basically comprising only the characteristics of interest of the current signal. Such a filtered and thus improved signal is amplified by the operational amplifier and the amplified signal is then adapted to be detected or evaluated more easily.

In an embodiment of the hair cutting apparatus, the current manipulator comprises a second high-pass filter configured to differentiate the amplified signal. This process of differentiating the amplified signal serves to eliminate a DC-offset of the amplified signal. An amplified signal, being the output of an operational amplifier, might comprise a DC-offset. For evaluating the current signal or the filtered current signal in order to identify hair-cutting actions, absolute values of such a signal are of less interest, whereas only particular characteristics of this signal are of interest in order to identify hair-cutting actions of the cutting element. Therefore, a DC-offset is not wanted or at least not helpful. The second high-pass filter has a time-differentiating effect and can thus eliminate the DC-offset by time-differentiating the amplified signal. This embodiment can also be combined with the embodiments described hereinbefore. In particular, the second high-pass filter can be combined with the operational amplifier, as explained herein-before with respect to the other filters.

In an embodiment of the hair cutting apparatus, the current manipulator comprises a second low-pass filter configured to eliminate residual high frequent noise of the amplified signal. In this embodiment it is assumed that the operational amplifier, which could be an operational amplifier according to any of the above described embodiments, provides, as the amplified output signal, an improved signal basically comprising time-derivatives associated with hair-cutting actions of the cutting element. However, this amplified signal might still comprise residual high frequent noise. The second low-pass filter is particularly used to eliminate or at least reduce such high frequent noise. The second low-pass filter is preferably set to a −3 dB range of 30-50 Hz. It was found that this frequency range is well suited to eliminate the described residual high frequent noise.

The second high-pass filter according to at least one previously mentioned embodiment and the second low-pass filter could also be combined into a single band-pass filter. Accordingly, the current detector could be provided with the second high-pass filter, or the second low-pass filter, or both said filters, possibly combined into a single band-pass filter. At least one of these filters is connected at least to an output of the operational amplifier as explained according to at least one of the above described embodiments.

The resulting output signal provided by any of these explained embodiments can be a filtered and/or amplified current signal basically only comprising time-derivatives related to hair-cutting actions of the cutting element. Such an output signal can be detected or evaluated in particular by comparing it with the predetermined threshold value.

In an embodiment of the hair cutting apparatus, the evaluator is configured to associate an occurrence of a value of the time derivative signal or the amplified signal being above the predetermined threshold value with a hair-cutting action of the cutting element. The evaluator may instantaneously provide an output signal, indicating a hair-cutting action, when the evaluator establishes that the time derivative signal or the amplified signal is above said predetermined threshold value. Accordingly, the time derivative signal or the amplified signal is compared with the predetermined threshold value, and any values thereof exceeding the threshold value indicate that a hair is actually being cut. In this manner a simple, effective and in particular robust way of evaluating the processed current signal is achieved. The processed current signal is basically the result of at least one of the filters and the operational amplifier according to at least one embodiment explained above. Accordingly, the processed current signal is a time derivative of the current signal and basically comprises only the characteristic components of the current signal of interest, namely the characteristic components related to hair-cutting actions of the cutting element.

The time derivative signal or the amplified signal can easily be evaluated with respect to whether a hair-cutting action is actually being performed by the cutting element. Basically, the amplitude of the current signal is not of interest. However, the current signal will in particular comprise peaks associated with the hair-cutting actions of the cutting element. According to the invention, such peaks are detected by determination of the time-derivative of the current signal. This will eliminate any DC components in the current signal, so that the peaks can easily be compared with the predetermined threshold value without being hampered by any DC components. It was found that such an evaluation is robust to slow motor torque changes due to wear, pollution or other influences.

In an embodiment of the hair cutting apparatus, the current sensor is provided as an analog electric circuitry, the current manipulator is provided as an analog electrical circuitry comprising an operational amplifier, and the evaluator is provided as a digital processor. The evaluator is configured to evaluate a processed current signal being an output signal of the current manipulator.

Accordingly, the current sensor and the current manipulator prepare the sensed signal in an analog way to provide said processed signal. In particular the circuitry provides a processed signal which basically only comprises characteristics of a time-differentiated signal associated with hair-cutting actions of the cutting element. Such a processed signal can be the input of a microprocessor, after having been digitized by an A/D-converter. Alternatively the A/D-converter is part of the microprocessor. The comparison of this processed signal with the predetermined threshold value can be done by the microprocessor and the result can be used for various applications. In particular it can be used to provide an indication of the actual occurrence of hair-cutting actions of the cutting element.

However, according to another embodiment it is also possible to perform the evaluation in a different way. One possibility is to use, instead of the microprocessor, an operational amplifier provided as a comparator. Accordingly, it is also possible to finally evaluate whether any hair-cutting actions are actually performed by the cutting element by using an analog evaluator, in particular any kind of suitable electric circuitry.

Alternatively, at least the current manipulator and the evaluator can also be provided in a digital manner. In particular the high-pass filters and low-pass filters described above can be realized as digital filters.

In an embodiment, the hair cutting apparatus comprises a cutting indicator configured to indicate a detected hair-cutting action of the cutting element, wherein the cutting indicator comprises a light indicator configured to be activated to instantaneously indicate whether a hair-cutting action of the cutting element is detected. The light indicator is thus activated instantaneously upon detection of a hair-cutting action by the hair cutting element. In this way, the user, while shaving, immediately recognizes whether hair is actually being cut or not. Thus, the user can e.g. move the shaver to another area of the skin when the light indicator indicates that no hairs are actually being cut. In particular, the light indicator e.g. stays off in case no hair is actually being cut and stays on as long as hairs are actually being cut.

Accordingly, hair-cutting actions of the cutting element are detected immediately and, depending on such detection, the light indicator or part of it can be activated instantaneously upon such detection to indicate whether hair is actually being cut or not. In this way the actual hair cutting actions by the shaver can be indicated. Any hair-cutting actions detected can instantaneously be indicated by the light indicator. In particular, the light indicator is activated when any hair-cutting action is detected. One possible way to indicate a hair-cutting action is to switch on the light indicator and let it be switched on for a short time, such as for one second or part of a second. In this way the user of the hair cutting apparatus can easily realize whether hair is actually being cut or not. The use of the light indicator has the advantage of providing an easy way of indicating whether hair is actually being cut or not. In this way the user is better aware of the current operational status of the hair cutting apparatus. Although cutting hair might in itself produce noise, the light indicator is an additional indication or help for the user to identify the operational status. E.g. if the hair cutting apparatus is a shaver, the user can easily identify regions where further shaving is needed.

It was also realized that using a light indicator to indicate whether a hair is currently being cut or not limits the negative influence of the changing or predominant sound or noise of the shaver, i.e. the natural sound of the shaver, such as the sound of the motor and any sound of the hair-cutting actions. In comparison e.g. to a solution providing amplified vibrations of the cutting element as an audible feedback, using a light indicator avoids the generation of any additional sound. Accordingly, as regards the sound, the shaver is operated in the way familiar to the user, but the light indicator provides a completely different signal and, thus, provides completely different and additional information, without changing the existing sound characteristics of the shaver. This is just an example relating to a shaver, but it may also relate to other kinds of hair cutting apparatuses.

In an embodiment of the hair cutting apparatus, the light indicator is arranged in the proximity of the cutting element. Usually, during shaving, the user looks at the cutting element, in particular at a cutting head of the hair cutting apparatus, in order to see where he is shaving. By placing the light indicator in the proximity of the cutting element, the user will also basically automatically see the light indicator as well. In this way, the additional information of whether hairs are actually being cut or not can easily be provided to the user by placing the light indicator in the proximity of the cutting element.

In an embodiment of the hair cutting apparatus, the light indicator has the shape of a partial ring. The light indicator is preferably provided as a C-shaped light indicator. This embodiment enables the light indicator to partially surround the hair cutting apparatus or the cutting element thereof. With such a shape, the light indicator can be provided in an area of the hair cutting apparatus which is particularly in the field of vision of the user. Simply speaking, the light indicator can be placed on an upper half of a casing of the hair cutting apparatus facing towards the eyes of the user during shaving. By using a partial ring, in particular a C-shaped ring, the light indicator can form part of one shell of the casing, in particular when the casing basically comprises two shells of a similar size, in particular two half shells.

In an embodiment of the hair cutting apparatus, the hair cutting apparatus comprises a progress determining unit for determining a status of progress of a hair-cutting process based on the detected hair-cutting actions. One possibility is to count the detected hair-cutting actions during a predefined time interval. With ongoing progress of a hair-cutting process, fewer hair-cutting actions will be detected during such a time interval.

In an embodiment of the hair cutting apparatus, the light indicator is adapted to be activated in different colors, at least in mutually different first and second colors, and the current detector is adapted to control the light indicator such that the first color is instantaneously generated when a hair-cutting action is detected and the second color is instantaneously generated when no hair-cutting action is detected. In this way the color generated by the light indicator informs the user about the actual hair-cutting process, for example the shaving process. At the beginning of a shaving session, the first color will be predominantly generated as long as hairs are being cut. Towards the end of the shaving session, the second color will be generated to an increasing extent. Alternatively, more than two colors can be generated and, in a particular embodiment, also a third color can be generated. The underlying idea is that, when hair-cutting actions are detected, it is suggested to provide a further and more detailed indication, such as an indication of the amount of hairs being cut, e.g. during a predetermined time interval. For that purpose at least a third color could be used.

If the progress of a shaving session is shown on a scale ranging from 0%, when the shaving session is started, to 100%, when no hairs are being cut anymore, the first color can correspond to and indicate approximately 0% to 33% of the progress, whereas the second color can correspond to and indicate approximately 33% to 66% of the progress, and the third color can correspond to and indicate approximately 66% to 100% of the progress. Using this scale, 0% can refer to an average value of a cutting process indicating the start of a shaving session. In an embodiment, 0% of the progress of a shaving session can refer to a certain number of hairs cut per second. The scale of 0% to 100% can also in general refer to said number of hairs cut per second.

In an embodiment of the hair cutting apparatus, the current detector is configured to provide a fading function for the light indicator enabling light generated by the light indicator to gradually change from the first color to the second color when the current detector detects a decreasing number of hairs being cut during a predetermined time interval. It is thus e.g. achieved that the light indicator gradually changes from the first color to the second color to indicate a transition from a condition wherein hairs are being cut to a condition wherein no hairs are being cut. In particular, the first color fades out when no hairs are being cut anymore and, concurrently, the second color fades in. In this way, with ongoing progress of shaving, the end of a shaving session is indicated by the color of the light indicator fading from the first color to the second color.

The light indicator can be provided as a plurality of light elements, in particular a plurality of LEDs. Multiple color light elements, in particular multiple color LEDs, can be used and, for fading from a first color to a second color, further colors can be used in between. To give one example, the color could change from red to blue and turn violet in between.

In an embodiment of the hair cutting apparatus, the light indicator comprises a plurality of light elements, and the progress determining unit is adapted to individually control the light elements to indicate the status of progress of the hair-cutting process by a number of light elements being activated. Such light elements, in particular LEDs, can be arranged as a bar, in particular as a partial ring, being particularly arranged in the proximity of the cutting element.

Such a bar can indicate the progress of the hair-cutting process by activating more and more light elements, in particular LEDs, as the progress of cutting hairs moves from 0% to 100%, or the other way around. In this way, the progress of the hair-cutting process is made visible by a light bar.

Accordingly, the light indicator can be activated at least by means of one of the light elements when hair-cutting actions of the cutting element are actually being detected, and all light elements can be switched off when no hair-cutting actions are actually being detected. But when hair-cutting actions are detected, it is suggested to provide a further and more detailed indication. This can simply be done by activating more or fewer light elements, depending on how many or how often hair-cutting actions are actually being detected. One way of detecting such information is to count the number of detected hair-cutting actions during a predefined time interval.

In an embodiment of the hair cutting apparatus, the light indicator is adapted to blink to indicate that no hair-cutting action is actually being detected. In this way, the end of a hair-cutting process, in particular the end of a shaving session, can be indicated quite easily. The light indicator can be activated without blinking as long as hairs are actually being cut, and can change to the blinking state when no hair cutting is actually being detected anymore. The activated light indicator indicates that the shaving apparatus is operating normally, and changes to the blinking state to indicate that the shaving process is completed. Alternatively, the light indicator is switched off when the apparatus operates normally, and only switches from off to blinking towards the end of the shaving session.

According to a second aspect of the present invention, a method is provided for detecting a hair-cutting action of a hair cutting apparatus according to the first aspect of the invention, wherein the method comprises the steps of sensing the motor current by using a current sensor and providing a current signal as a function of time, indicative of the sensed motor current, determining a time derivative signal of the current signal using the current manipulator, and detecting whether the time derivative signal or an amplified signal of the time derivative signal is above a predetermined threshold value to detect a hair-cutting action of the cutting element, using the evaluator.

According to this method, the motor current is sensed by a current sensor, and the resulting current signal is provided to the current manipulator. The current manipulator determines a time derivative of the current signal that is indicative of hair-cutting actions of the cutting element.

This method is particularly suitable for use with a hair cutting apparatus according to any of the before described embodiments. In this way, a hair cutting apparatus can be provided which enables detection or evaluation of a motor current in order to provide or use information about whether or not actual hair-cutting actions of the cutting element are being detected.

In an embodiment of the present invention, the method further comprises the steps of eliminating high frequency components of the current signal caused by torque changes of the drive system coupling the motor to the cutting element by using a first low-pass filter providing a first filtered signal, determining a time derivative signal of the first filtered signal by using the first high-pass filter, amplifying the time derivative signal into an amplified signal by using an operational amplifier, differentiating the amplified signal by using a second high-pass filter to eliminate a DC-offset of the amplified signal, and eliminating a residual high frequent noise of the differentiated amplified signal by using a second low-pass filter to provide a processed current signal. The steps of the method according to the invention can be performed by means of a hair cutting apparatus according to at least one of the above explained embodiments and in particular by using at least one of the above described first and second high-pass filters and low-pass filters and the operational amplifier. These steps are performed in a way as described above with respect to said embodiments of the hair cutting apparatus, and they also have the advantages explained there.

Preferably, the part of the hair cutting apparatus detecting or evaluating the motor current in order to detect any hair-cutting actions of the cutting element is provided in a way as described in the above-explained corresponding embodiments of a hair cutting apparatus, and/or the method according to the invention is performed as explained above for any method performed by any of the corresponding embodiments of the hair cutting apparatus as explained above.

It shall be understood that the hair cutting apparatus and the method for detecting a motor current have similar and/or identical preferred embodiments, in particular as defined in the dependent claims.

It shall be understood that a preferred embodiment of the present invention can also be any combination of the dependent claims, or of the embodiments as described hereinbefore, with the respective independent claim.

These and other aspects of the invention will be apparent from and elucidated with reference to the embodiments described hereinafter.

BRIEF DESCRIPTION OF THE DRAWINGS

In the following drawings:

FIG. 2 is a current detector for detecting a motor current of the motor shown in

FIG. 1,

DETAILED DESCRIPTION OF THE EMBODIMENTS

Figure 1:
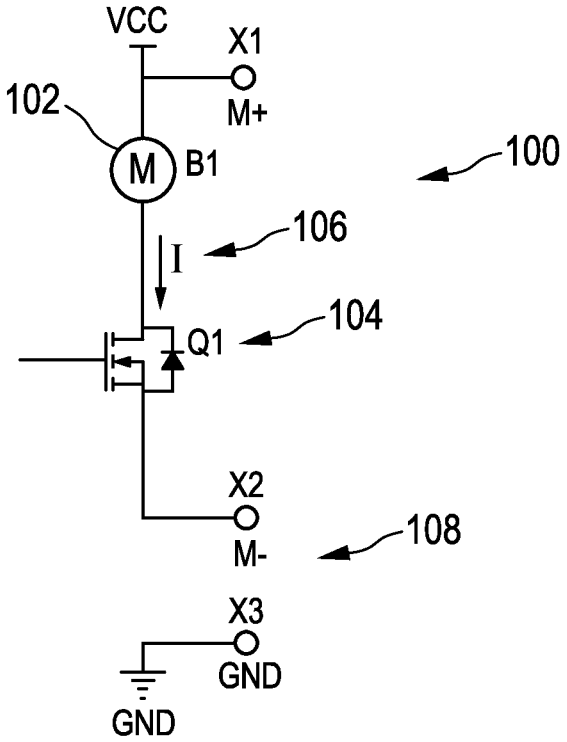
FIG. 1 is an electric circuitry of a hair cutting apparatus comprising a motor and a switch for switching.

FIG. 1 shows an electric circuitry 100 of a shaver as an example of a hair cutting apparatus. This circuitry 100 comprises a motor 102 and a switching device 104 for controlling the motor 102. A DC motor current 106, also indicated with the capital letter I, can flow through the motor 102 and the switching device 104 to an interface 108 having the connection points X2 and X3.

Figure 2:
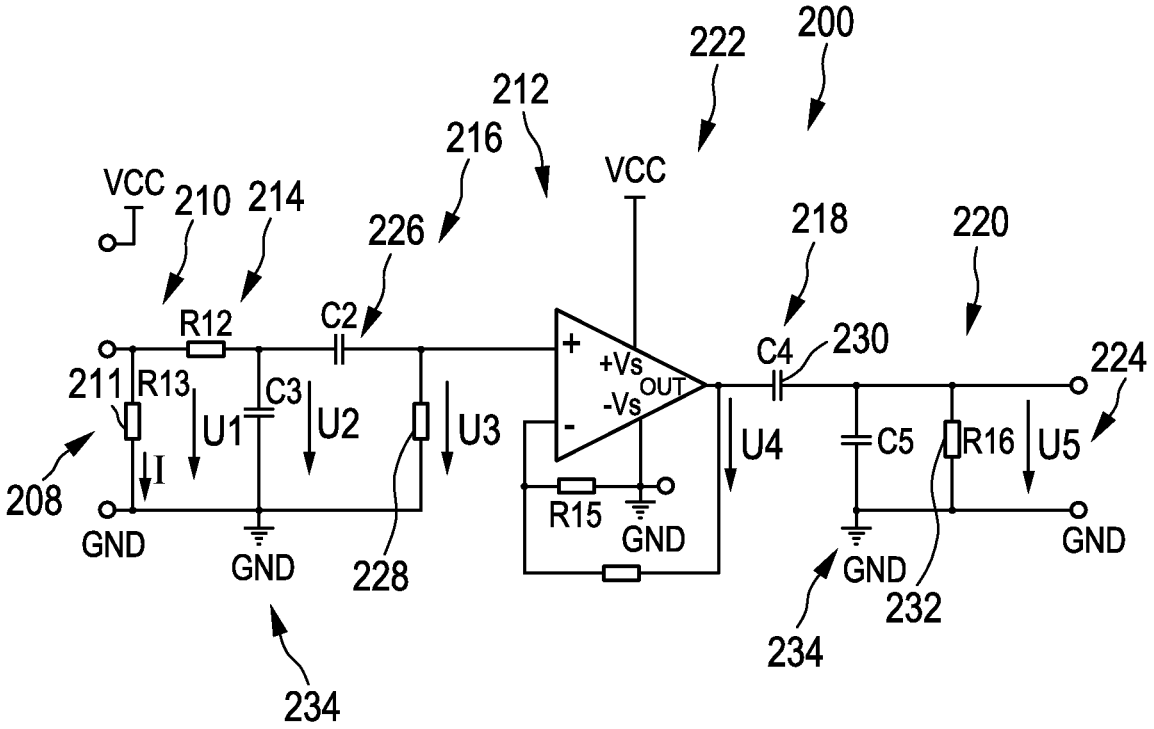

The motor current 106 can be sensed and detected with the current detector 200 shown in FIG. 2, which will be connected to the connection points X2 and X3 of the interface 108 of FIG. 1.

FIG. 2 shows the current detector 200 having an interface 208 for connection to the interface 108 of the electric circuitry according to FIG. 1. Accordingly, the connection points X2 and X3 are indicated with the same letter numbers. In fact this can also be understood as a possibility of dividing the technical drawing of the circuitry into two drawings. In the same manner, the connection point X1 is also present in FIGS. 1 and 2. The current detector 200 basically comprises a current sensor 210 and the current manipulator 212, which is basically the rest of the current detector. The current sensor 210 basically just comprises a sense resistor 211, so that there is a voltage drop U1 across this sense resistor 211 which is basically proportional to the motor current I shown as motor current 106 in FIG. 1.

The current manipulator 212 basically comprises a first low-pass filter 214, a first high-pass filter 216, a second high-pass filter 218 and a second low-pass filter 220 as well as an operational amplifier 222. The purpose of the current manipulator 212 is to provide a processed current signal U5 at the output 224 of the current manipulator 212.

The working principle of the current detector consists of a current sensing circuit, a filter circuit and an amplification circuit and can be explained using FIG. 2.

The motor current 106 is sensed at the sense resistor 211, resulting in a voltage signal U1. The voltage signal U1 is an example of a current signal indicative of the motor current. The voltage signal U1 is fed to the first low-pass filter 214 having a −3 dB frequency of 2 Hz. This low-pass filter 214 eliminates all high frequency components due to commutation, but also high frequency components due to torque changes, which basically appear as noise produced by the drive train and shaving system.

The output of the first low-pass filter 214 is fed into a series capacitor 226 of the first high-pass filter 216. The series capacitor 226 acts to time-differentiate the voltage signal U2 which is the output of the first low-pass filter 214. The filter cutoff frequency of the first high-pass filter 216 can be in a −3 dB range of 2 Hz to 20 Hz.

The function of this series capacitor 226 is to pass only the time derivative signal dI/dt of the signal coming from the first low-pass filter 214. The output of the first high-pass filter will be zero when there are no current changes, due to the differentiating character of the first high-pass filter.

It was found that for setting a detection threshold, this differentiated voltage U3, which is the output of the first high-pass filter 216, will be easier to use, because there is no DC bias between multiple circuits. So, the absolute motor current or an absolute current signal indicative of the motor current is not present anymore in this voltage.

A discharge resistor 228 is connected between the output of this series capacitor 226 and ground, in order to discharge the capacitor 226.

Because filtering will cause signal gain loss, the operational amplifier 222 is provided. It is used to boost the output signal of the first high-pass filter 216, namely the voltage U3. The output voltage U4 of the operational amplifier is connected to a further series capacitor 230, which is part of the second high-pass filter 218. This further series capacitor 230, and thus the second high-pass filter 218, works as a differentiator to eliminate a DC offset which is generated by the operational amplifier 222.

This further series capacitor 230 has also a discharge resistor 232 connected between the output of the series capacitor 230 and ground 234 to discharge the further series capacitor 230, as it was found that otherwise the signal will be clipped.

The signal coming out of the series capacitor 230 will be fed into the second low-pass filter 220 to eliminate residual high frequent noise. The cutoff frequency of the second low-pass filter 220 is in the range of 30 Hz to 50 Hz.

The result of the current detector 200 and thus of the current manipulator 212 is the voltage U5 at the output 224.

Figure 5:
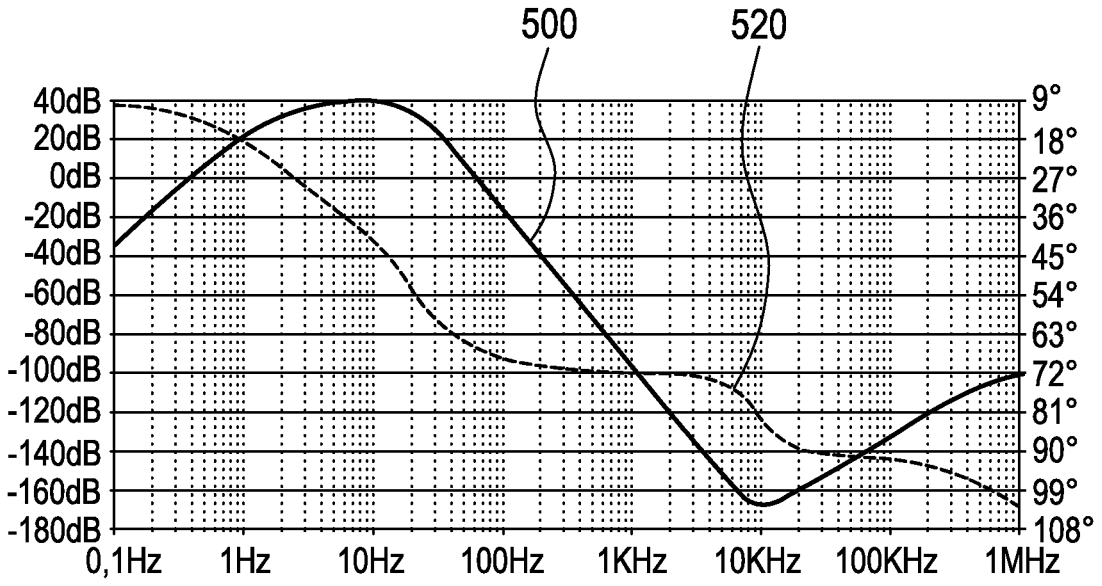
FIG. 5 is a Bode-Diagram of a current manipulator.

The total gain of the current manipulator 212 is 40 dB and therefore 100V/V. This is also illustrated in the Bode-Diagram according to FIG. 5. That Bode-Diagram shows the curve of the gain 500 in dB and the curve of the phase 520 in degrees over the logarithmic frequency. For the final evaluation purpose of the current manipulator, the curve of the phase is of less interest. The curve of the gain 500 shows the highest value of about 40 dB at 10 Hz and falls to 0 dB at about 60 Hz. From 0.4 Hz to 60 Hz the gain is above 0 dB.

When contrary to the suggested principle an absolute value of the motor current is used for evaluation, the problem occurs that, when the load changes e.g. due to wear or by using a different interchangeable shaving or grooming unit, the absolute value of the motor current will change substantially. It was found that setting a threshold value for detecting peaks of such an absolute motor current will not be robust enough to handle torque changes over time, because the no-load current will change.

In view of that, the advantage of the present working principle, in particular as explained using the example of FIG. 2, is that the enhancing of the changes in the current signal associated with hair-cutting actions of the cutting element is not very sensitive to slow changes of the system and thus is robust to changes of the system. In other words, the explained electronics automatically adapt to slow torque changes due to wear, pollution and so on.

Figure 3:
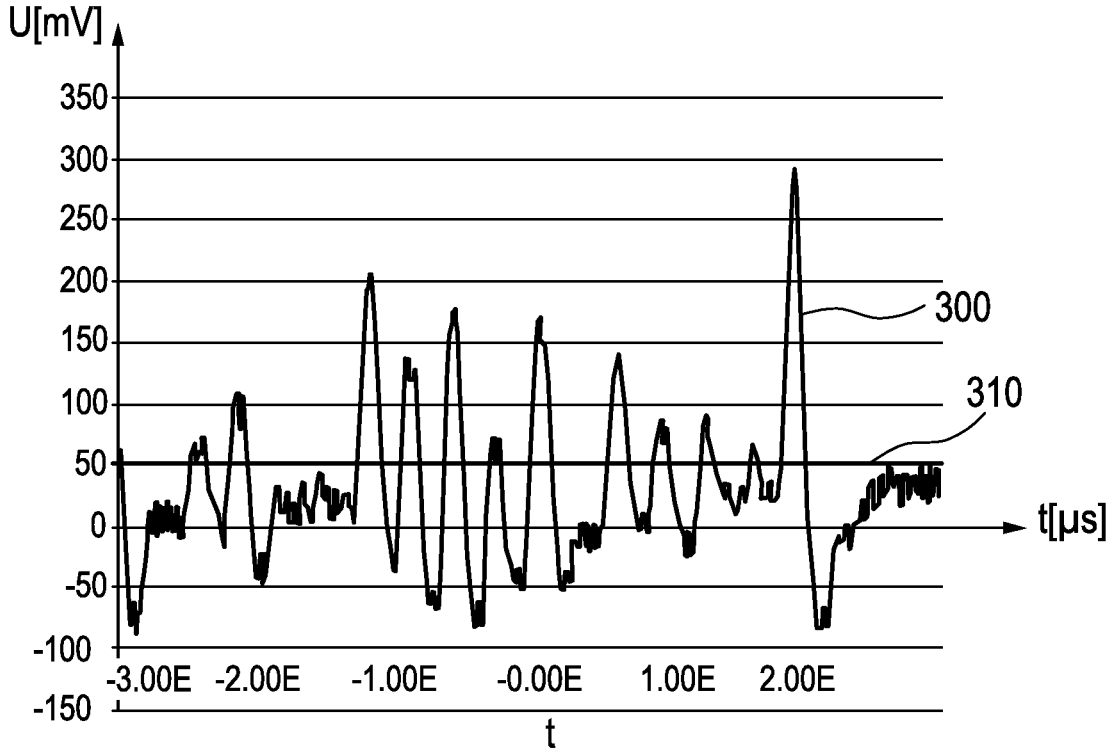
FIG. 3 is a diagram showing a processed current signal and a threshold value.
Figure 4:
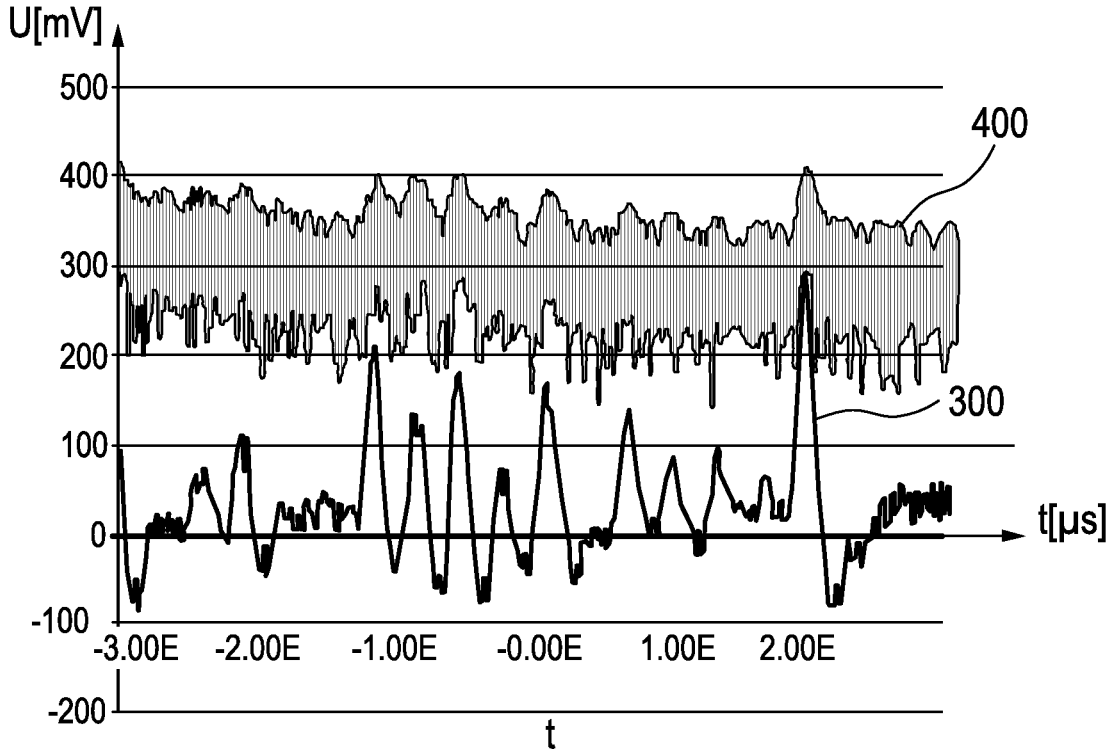
FIG. 4 is a diagram showing a processed current signal of a motor current and the motor current.

Results illustrating this are shown in FIGS. 3 and 4. FIG. 3 shows the processed current signal 300 that shows the output voltage U5 at the output 224 of FIG. 2 over time. The graph also shows a threshold value 310. FIG. 4 also shows the processed current signal 300 and in addition the current signal 400 which is the voltage U1 of FIG. 2 over time.

FIG. 3 illustrates that peaks of the processed current signal 300 can easily be detected by comparing the processed current signal 300 with the threshold value 310. Even large changes of the processed current signal 300, which might occur due to changes of the shaver, will not change the result of the comparison.

FIG. 4 shows the current signal 400 and that makes clear that any peaks are difficult to detect. However, besides the superimposed noise, the DC-portion of the current signal 400 is much bigger that the overlaid characteristics which are associated with hair-cutting actions of the cutting element. Accordingly, any changes of the amplitude of the current signal 400 affect the amplitude of the overlaid characteristics even more. The suggested solution prevents this problem, because the processed current, inter alia, eliminates the DC-portion.

Figure 6:
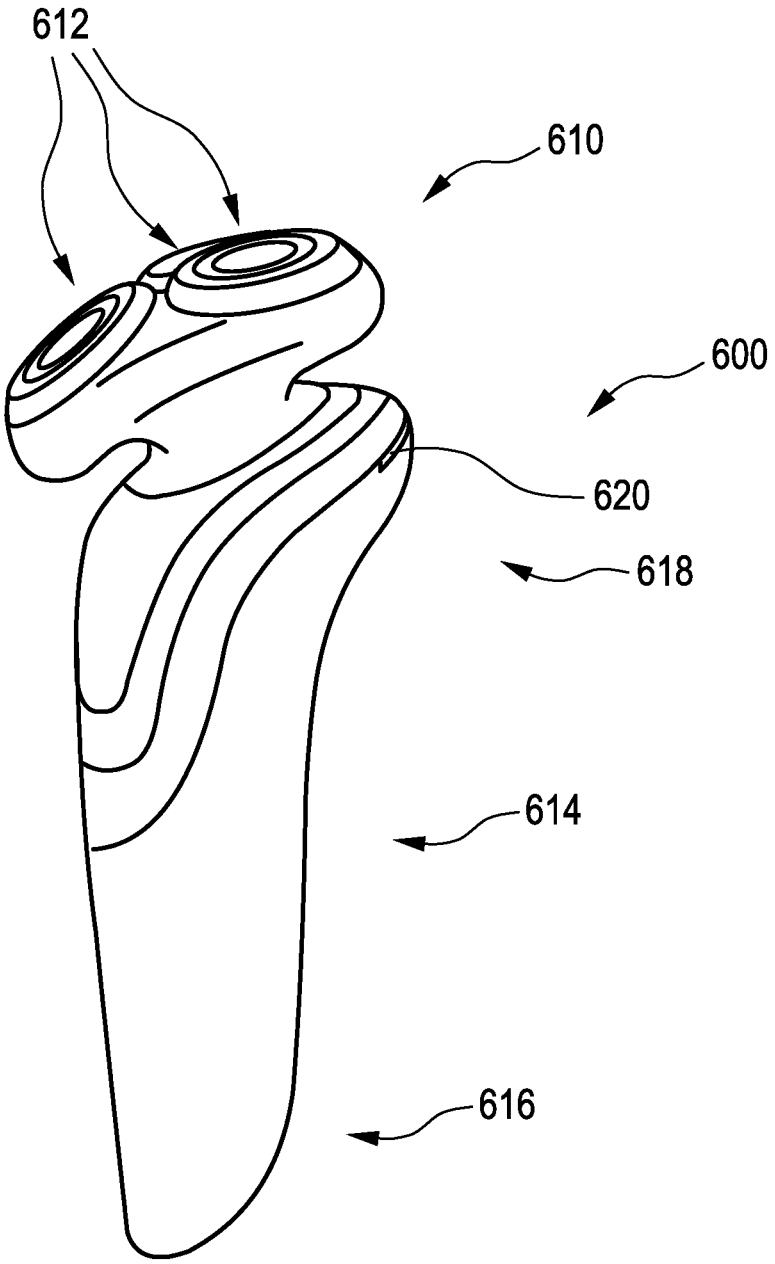
FIG. 6 is a schematic view of a shaver as an example of a hair cutting apparatus.

FIG. 6 shows a hair cutting apparatus 600 having a shaving head 610 comprising a plurality of cutting elements 612. The cutting elements 612 of this embodiment are basically arranged in three groups, each group being prepared to rotate in order to cut hair. The shaving head is attached to a main body 614 of the hair cutting apparatus 600. The main body is also designed to be hand-held by a user when used for shaving.

The main body comprises a lower end 616 and an upper end 618 arranged towards the shaving head 610. At the upper end, in the proximity of the shaving head 610 and thus in the proximity of the cutting elements 612, there is provided a light indicator 620 which is part of a cutting indicator. During use, the light indicator 620 indicates whether hairs are actually being cut or not by the cutting elements 612. When using the hair cutting apparatus 600, the shaving head 610 contacts the skin with the cutting elements 612. While shaving, the user looks at the skin near the shaving head 610 and therefore also looks at the shaving head and, consequently, sees the light indicator 620 as well. In this way, the user can easily recognize whether hairs are actually being cut and can move the shaver accordingly.

Figure 7:
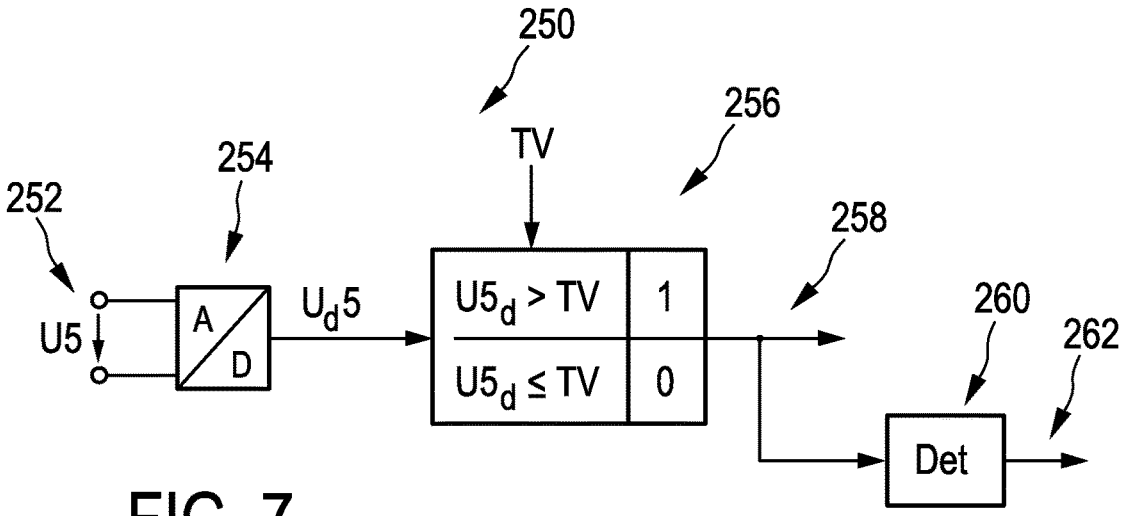
FIG. 7 is an evaluator configured to compare a time derivative signal with a predetermined threshold value.

FIG. 7 shows an evaluator 250 having the output voltage U5 at the output 224 of FIG. 2 as an input voltage at the evaluator input 252. This inputted analog voltage U5 is converted in the AD-converter 254 into a digital derivative signal $U5_d$ that is inputted in the comparator 256. A predetermined threshold value TV is also inputted in the comparator 256. The comparator compares these values and provides a comparison result at the output 258. That result can be the value "1" if the digital derivative signal $U5_d$ is larger than the predefined threshold value TV, or the result can be the value "0" otherwise. Accordingly, the value "1" at the output 258 of the comparator 256 and thus at the evaluator 250 indicates an operating condition wherein a hair is actually being cut by any of the cutting elements 612.

The output 258 can be used for different purposes. In a first example, the output 258 is used to directly control the light indicator 620 such that the light indicator 620 is activated to instantaneously indicate whether or not a hair-cutting action of the cutting elements 612 is actually detected by the hair-cutting detector. This can be realized by configuring the light indicator 620 such that, when the output 258 provides the value "1", the light indicator 620 will be activated and, when the output 258 provides the value "0", the light indicator 620 will not be activated. For this purpose, the light indicator 620 might be provided with suitable electronics having an input for receiving an output signal from the output 258. Alternatively, the light indicator 620 might be configured to be able to generate light of different colors. In such an embodiment, the light indicator 620 is activated in a first color when receiving the value "1" from the output 258 to indicate an actual hair-cutting action, and the light indicator 620 is activated in a second color, different from the first color, when receiving the value "0" from the output 258 to indicate that actually no hairs are being cut. Alternatively, the light indicator 620 might be configured to be able to generate light in a continuous mode as well as in a blinking mode. In such an embodiment, the light indicator 620 is activated to generate light in the continuous mode when receiving the value "1" from the output 258 to indicate an actual hair-cutting action, and the light indicator 620 is activated in the blinking mode when receiving the value "0" from the output 258 to indicate that actually no hairs are being cut.

The output 258 can also be used to additionally detect a progress of a hair-cutting process. For this purpose, the signal of the output 258 is input into a progress determining unit 260 for further processing. The progress determining unit 260 can determine the progress of the hair-cutting process in a particular manner, for example by counting a number of detected hair-cutting actions during a predetermined time interval, or by identifying time intervals between consecutively detected hair-cutting actions. The result of this counting process may provide an indication of the progress of the hair-cutting process. For example, a relatively high number of detected hair-cutting actions during a predetermined time interval or a relatively short time interval between consecutively detected hair-cutting actions may indicate an early stage of the hair-cutting process, whereas a relatively low number of detected hair-cutting actions during a predetermined time interval or a relatively long time interval between consecutively detected hair-cutting actions may indicate a late stage of the hair-cutting process. The progress determining unit 260 might comprise suitable software to provide an output signal at its output 262 indicating the degree of progress of the hair-cutting process. This software might determine the output signal, depending on the signal received from the output 258 of the comparator 256.

The output 262 of the progress determining unit 260, i.e. the degree of progress of the hair-cutting process, may be visualized by means of the light indicator 620, in different ways. The light indicator 620 may e.g. be provided with a plurality of individual light sources such as LEDs (not shown in the figures), wherein the number of activated individual light sources is dependent on the determined degree of progress of the hair-cutting process. For example, an early stage of the hair-cutting process is indicated by activating all light sources, a late stage of the hair-cutting process is indicated by activating only few light sources or a single light source, while no light source is activated when actually no hair-cutting actions are detected. Any intermediate stage of the hair-cutting process might be indicated by activation of a proportional number of light sources. In an alternative embodiment as described hereinbefore, wherein the light indicator 620 is configured to be activated in two different colors, the light indicator 620 might be configured to provide a fading function enabling the light generated by the light indicator 620 to gradually change from the first color to the second color, depending on the signal received from the output 262 of the progress determining unit 260. In this embodiment, an early stage of the hair-cutting process is indicated by activating the light indicator 620 in the first color. An end stage of the hair-cutting process, wherein no hair-cutting actions are actually being detected, is indicated by activating the light indicator 620 in the second color, while any intermediate stage of the hair-cutting process might be indicated by activating the light indicator 620 in an intermediate color between the first and the second colors. For this purpose, the light indicator 620 might comprise a number of LEDs of different colors.

Figure 8:
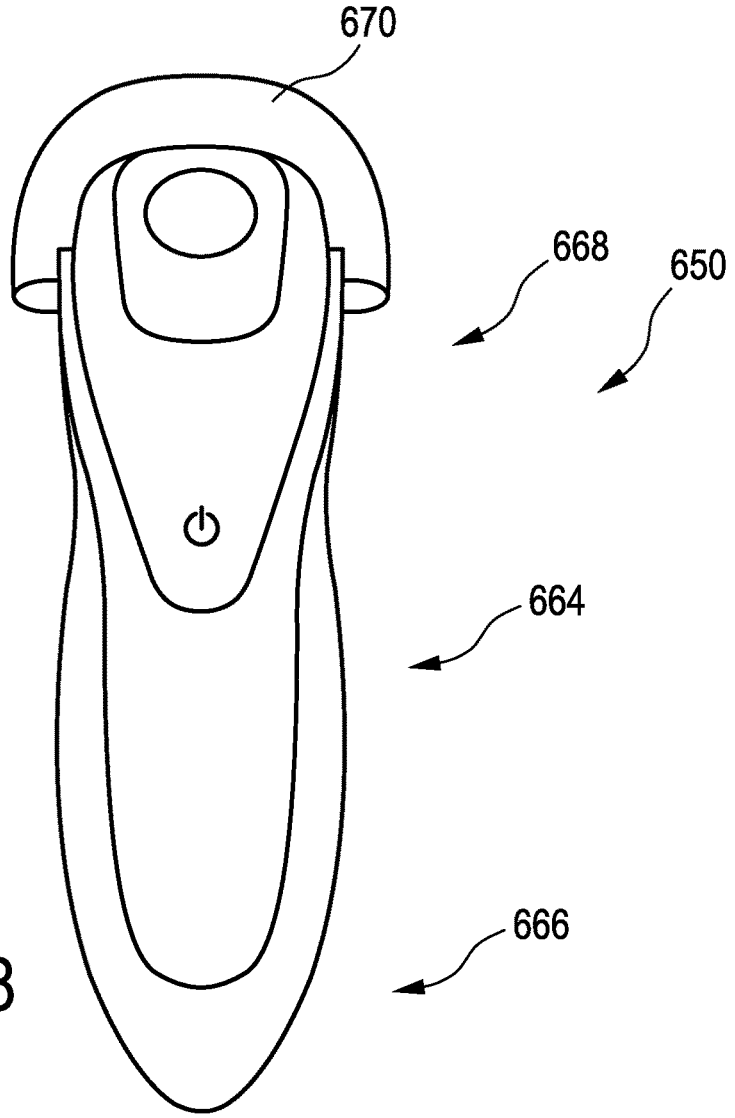
FIG. 8 is a schematic view of a further shaver as an example of a hair cutting apparatus.

FIG. 8 shows a hair cutting apparatus 650 having a main body 664. The main body 664 is also designed in a way to be held by the hand of a user when the apparatus is used for shaving. The main body 664 comprises a lower end 666 and an upper end 668 arranged towards a shaving head which is not shown in this figure. At the upper end 668, in the proximity of the shaving head and thus in the proximity of cutting elements, there is provided a light indicator light 670 which is part of a cutting indicator. During use, the light indicator 670 indicates whether hairs are actually being cut or not by the cutting elements. The light indicator 670 has the shape of a partial ring, i.e. it is substantially C-shaped. The light indicator 670 partially surrounds the upper end 668 of the shaver 650. The shaving head and thus the cutting elements are basically right behind the light indicator 670.

Accordingly, one idea is to use filters and an amplifier to make the conventional motor current measurement in shaving and grooming devices more robust. It was found that some functions in a shaver can be improved by a robust current measurement. Such robust current measurement is suggested and used to detect hair-cutting actions or to measure hair density. By using filters and an amplifier the current peaks in the motor current associated with hair-cutting actions can be derived from a noise-shaped motor current. This solution is robust enough to reliably detect the current peaks in the motor current associated with hair-cutting actions in case of pollution and in case of using different types of interchangeable shaving or grooming units, such as shaver-type, trimmer-type and brush-type attachments.

It was found that at least one conventional sense resistor motor current measurement used in shaving and grooming devices works as follows. Simple motor current measurement measures the voltage drop across a sense resistor. Such a resistor might have a value of 0.05 Ohm. A microcontroller's AD converter measures the sense resistor voltage drop. The AD converter value, which is a 10-bit value most of the time, is input to measure the absolute motor current by using Ohm's law. The result looks similar to the current signal 400 shown in FIG. 4 and is evaluated by analyzing it.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality.

A single unit or device may fulfill the functions of several items recited in the claims. The mere fact that certain measures are recited in mutually different dependent claims does not indicate that a combination of these measures cannot be used to advantage.

An improvement or replacement of such measurement is suggested and that can particularly be used for an appliance that has a light ring or divided light ring to show the cutting of the beard. Such an appliance is suggested. The suggested solution uses the motor current to detect the cutting torque. To make this function robust it is suggested to make the conventional motor current measurement more robust to slow torque changes caused by wear, unit replacement and pollution of the shaving system.

Any reference signs in the claims should not be construed as limiting the scope.

This solution particularly provides a suggestion to overcome the problem of setting a threshold level for motor current detection in appliances.

The suggested solution is an improvement to solutions which are tailored to an exact system and which do not consider variations in motor current for each shaver or groomer. It was found that it is difficult to set a threshold level in the current because of variation in torque of shaving systems due to pollution, friction differences or wear.

The suggested solution can particularly be used in male skin care products, shavers, grooming devices and hair clippers.

The invention claimed is:

1. A hair cutting apparatus comprising:

a cutting element configured to cut hair, a motor configured to drive the cutting element for cutting the hair when powered by a motor current, and a current detector configured to detect the motor current as a function of time, the current detector comprising:

a current sensor configured to sense the motor current and to provide a current signal indicative of the sensed motor current, wherein the current detector further comprises a current manipulator configured to determine a time derivative signal of the current signal, wherein the current manipulator comprises an evaluator configured to detect whether the time derivative signal or an amplified signal of the time derivative signal is above a predetermined threshold value to detect a hair-cutting action of the cutting element.

2. The hair cutting apparatus according to claim 1, wherein the current manipulator comprises a first high-pass filter adapted to determine the time derivative signal of the current signal.

3. The hair cutting apparatus according to claim 2, wherein the current manipulator comprises a second high-pass filter configured to differentiate the amplified signal to eliminate a DC-offset of the amplified signal.

4. The hair cutting apparatus according to claim 1, wherein a first high-pass filter comprises a series capacitor.

5. The hair cutting apparatus according to claim 1, wherein the hair cutting apparatus comprises a drive system coupling the motor to the cutting element, and wherein the current manipulator comprises a first low-pass filter configured to eliminate high frequency components of the current signal caused by torque changes of the drive system.

6. The hair cutting apparatus according to claim 5, wherein the current manipulator comprises a second low-pass filter configured to eliminate residual high frequent noise of the amplified signal.

7. The hair cutting apparatus according to claim 1, wherein the current manipulator comprises an operational amplifier configured to amplify the time derivative signal into the amplified signal.

8. The hair cutting apparatus according to claim 1, wherein the evaluator is configured to associate an occurrence of a value of the time derivative signal or the amplified signal being above the predetermined threshold value with a hair-cutting action of the cutting element.

9. The hair cutting apparatus according to claim 1, wherein the current sensor is provided as an analog electric circuitry, the current manipulator is provided as an analog electrical circuitry comprising an operational amplifier, and the evaluator is provided as a digital processor.

10. The hair cutting apparatus according to claim 1, further comprising a cutting indicator configured to indicate a detected hair-cutting action of the cutting element, wherein the cutting indicator comprises a light indicator configured to be activated to instantaneously indicate whether a hair-cutting action of the cutting element is detected.

11. The hair cutting apparatus according to claim 10, wherein the light indicator is arranged in the proximity of the cutting element.

12. The hair cutting apparatus according to claim 10, comprising a progress determining unit for determining a status of progress of a hair-cutting process, based on the detected hair-cutting actions.

13. The hair cutting apparatus according to claim 12, wherein the light indicator comprises a plurality of light elements, and wherein the progress determining unit is adapted to individually control the light elements to indicate the status of progress of the hair-cutting process by a number of light elements being activated.

14. The hair cutting apparatus according to claim 10, wherein the light indicator is adapted to be activated in different colors, at least in mutually different first and second colors, and wherein the current detector is adapted to control the light indicator such that the first color is instantaneously generated when a hair-cutting action is detected and the second color is instantaneously generated when no hair-cutting action is detected.

* * * * *